US007540676B2

(12) United States Patent
Ogawa et al.

(10) Patent No.: US 7,540,676 B2
(45) Date of Patent: Jun. 2, 2009

(54) MANUAL SHEET FEEDING MECHANISM

(75) Inventors: Tatsuya Ogawa, Kyoto (JP); Masahiko Fujita, Nara (JP); Masatsugu Ohishi, Nara (JP); Masaya Asakawa, Yamatokoriyama (JP); Yasuaki Fukada, Nara (JP); Tadasu Taniguchi, Nara (JP); Masaharu Kimura, Daito (JP); Rei Nakamura, Naruto (JP); Norichika Katsura, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 522 days.

(21) Appl. No.: 11/350,004

(22) Filed: Feb. 8, 2006

(65) Prior Publication Data

US 2006/0182485 A1 Aug. 17, 2006

(30) Foreign Application Priority Data

Feb. 14, 2005 (JP) ..... 2005-035770

(51) Int. Cl.
*G03G 15/00* (2006.01)
*G03G 21/00* (2006.01)
*B65H 1/04* (2006.01)

(52) U.S. Cl. ..... 400/624; 400/629; 399/392

(58) Field of Classification Search ..... 399/392
See application file for complete search history.

(56) References Cited

U.S. PATENT DOCUMENTS

| | | | | |
|---|---|---|---|---|
| 7,062,216 | B2 * | 6/2006 | Nobe et al. | 399/391 |
| 2005/0062217 | A1 * | 3/2005 | Asada | 271/162 |

FOREIGN PATENT DOCUMENTS

| | | | |
|---|---|---|---|
| JP | 07109052 | A * | 4/1995 |
| JP | 11180602 | A * | 7/1999 |
| JP | 2003-015503 | | 1/2003 |
| JP | 2003-295733 | | 10/2003 |
| JP | 2004035217 | A * | 2/2004 |

* cited by examiner

*Primary Examiner*—Daniel J Colilla
(74) *Attorney, Agent, or Firm*—Renner, Otto, Boisselle & Sklar, LLP

(57) ABSTRACT

A manual sheet feeding mechanism adapted for use in a sheet processing apparatus includes a manual feeding tray and a guiding member. The manual feeding tray is adapted to be mounted on a side wall of the apparatus so as to be pivotable about an axis between an open position and a closed position. The manual feeding tray has a placement surface for placing a sheet to be manually fed into the apparatus. The guiding member is adapted to position a sheet placed on the placement surface and is provided so as to be movable on the placement surface. The manual sheet feeding mechanism also includes a moving member that is adapted, when the manual feeding tray is pivoted toward the closed position, to move the guiding member on the placement surface.

8 Claims, 5 Drawing Sheets

MANUAL SHEET FEEDING MECHANISM

CROSS REFERENCE

This Nonprovisional application claims priority under 35 U.S.C. § 119(a) on Patent Application No. 2005-035770 filed in Japan on Feb. 14, 2005, the entire contents of which are hereby incorporated by reference.

BACKGROUND OF THE INVENTION

The invention relates to a manual sheet feeding mechanism adapted to feed sheets from a manual feeding tray into an apparatus on which the mechanism is installed. The invention relates in particular to a manual sheet feeding mechanism adapted for use in a sheet processing apparatus for processing certain processes to sheets, such as an image forming apparatus.

There are several sheet feeding methods used in such sheet processing apparatus. By the first method, sheets are fed from a sheet cassette provided in a sheet feeding section of such apparatus. By the second method, sheets are fed from a manual feeding tray provided in a manual sheet feeding mechanism that is mounted on a side wall of such apparatus.

The sheet cassette is used for storing a plurality of sheets of a size, often of a fixed size. Usually, sheets to be stored in the sheet cassette are ones that are frequently processed by such apparatus, e.g., plain paper sheets of standard size such as A4, A3, B4, or B5.

In contrast, the manual sheet feeding mechanism is used for feeding sheets that are less frequently processed, such as postcards, envelopes, and boards. The manual feeding tray has a placement surface on which guiding members are provided for positioning sheets along a perpendicular direction to a sheet feeding direction.

The guiding members are adapted to have contact with two respective side surfaces of the tray that are oriented parallel to the sheet feeding direction. The guiding members are slidable along the perpendicular direction so as to be adjustable to various sizes of sheets.

JP 2003-295733A discloses an image forming apparatus on a side wall on which a manual feeding tray is movably mounted. With no sheets to be placed thereon, the manual feeding tray is retractable to a position where a placement surface of the tray is oriented approximately parallel to the side wall.

However, projection of the guiding members from the placement surface requires a concavity in the side wall in which the guiding members are to be fitted, for proper retraction of the tray. This leads to problems with downsizing the apparatus as well as with simplifying an inner construction of the apparatus, as described below.

Since small-sized sheets such as postcards are sometimes placed on the manual feeding tray, the guiding members are arranged adjacent to the side wall of the apparatus. Inside the apparatus, on the other hand, sheet feeding devices such as a pick-up roller, sheet separating rollers, transporting rollers are arranged adjacent to the side wall for feeding and transporting sheets placed on the tray. Namely, the tray and the sheet feeding devices are arranged approximately in alignment on either side of the side wall.

Accordingly, the concavity requires the sheet feeding devices to be spaced from the side wall a sufficient distance to prevent the sheet feeding devices from having contact with the guiding members as fitted in the concavity when the tray is retracted. This causes the apparatus to be large in size. The concavity results in a relatively large distance between the tray and the sheet feeding devices. The concavity also requires a complex configuration such as to allow the pick-up roller to be arranged opposite an upper surface of sheet placed on the tray.

Also, since the guiding members are slidable on the placement surface of the tray along the perpendicular direction to the sheet feeding direction, it is impossible to specify an area of the side wall in which the guiding members are to be located when the tray is retracted in the apparatus. In order to ensure that the guiding members are prevented from having contact with the side wall when the tray is retracted in the apparatus, therefore, the concavity needs to be formed so as to cover the entire width of the side wall along the perpendicular direction to the sheet feeding direction. The concavity creates a large dead space inside the apparatus, thereby causing the apparatus to be large in size.

A feature of the invention is to provide a manual sheet feeding mechanism that has a manual feeding tray adapted to be prevented from having contact with devices provided in an apparatus on which the tray is mounted, when the tray is retracted in a side wall of the apparatus.

Another feature of the invention is to provide a manual sheet feeding mechanism with guiding members adapted to be retracted to such positions as to prevent an apparatus on which the tray is mounted from being large in size and complex in inner construction.

SUMMARY OF THE INVENTION

A manual sheet feeding mechanism of the invention is adapted for use in a sheet processing apparatus. The mechanism includes a manual feeding tray, a guiding member, and a moving member. The manual feeding tray is adapted for a sheet to be fed into the apparatus to be placed thereon. The guiding member is adapted to position the sheet on a placement surface of the manual feeding tray. The moving member is adapted, when the manual feeding tray is pivoted toward a closed position, to move the guiding member on the placement surface.

The construction allows the guiding member to be moved on the placement surface automatically when the manual feeding tray is pivoted from an open position to the closed position. Thus, the moving member allows the guiding member to be properly positioned. More specifically, the moving member allows the guiding member to be positioned properly for placement of a sheet on the placement surface when the manual feeding tray is in the open position, and to be positioned so as not to have contact with components provided inside the apparatus automatically when the tray is pivoted toward the closed position.

In one aspect of the invention, the moving member is adapted, when the manual feeding tray is pivoted toward the closed position, to move the guiding member in a first direction, e.g., in a direction away from an axis about which the tray is pivoted. In another aspect of the invention, the moving member is further adapted, when the manual feeding tray is pivoted toward the closed position, to move the guiding member in a second direction perpendicular to the first direction.

The invention thus allows the guiding member to be moved to a position away from components provided inside the apparatus, such as sheet transporting devices, when the manual feeding tray is pivoted toward the closed position. Accordingly, the invention prevents the guiding member from having contact with the components when the manual feeding tray is in the closed position, even in a case in which the components are arranged adjacent to the tray.

DETAILED DESCRIPTION OF THE INVENTION

Figure 1:
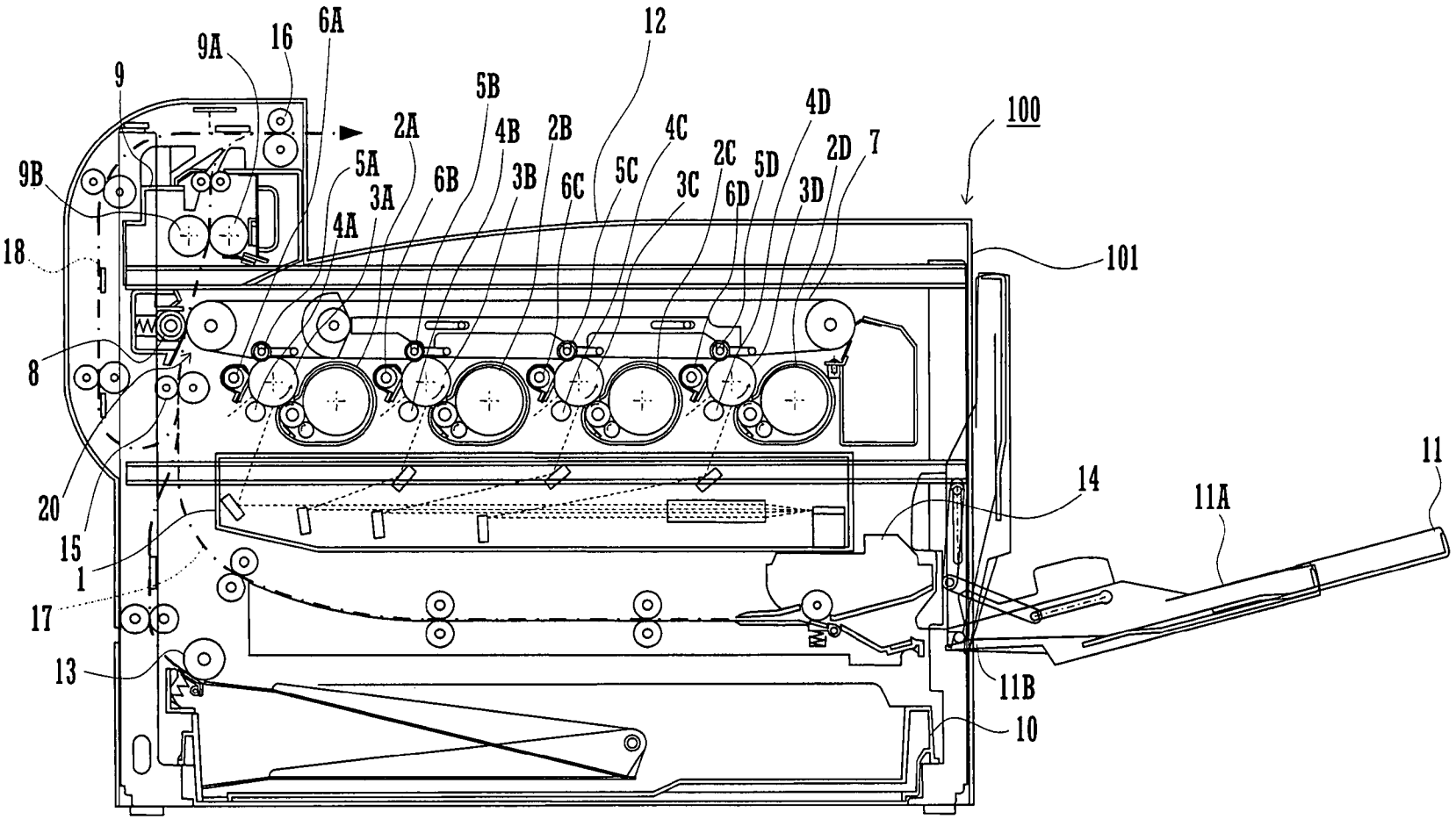
FIG. 1 is a diagram illustrating a schematic construction of an image forming apparatus provided with a manual sheet feeding mechanism according to an embodiment of the invention.

FIG. 1 is a diagram illustrating a schematic configuration of an image forming apparatus provided with a manual sheet feeding mechanism according to an embodiment of the invention. An image forming apparatus 100 forms a monochromatic or full-color image on a sheet by performing electrophotographic image forming processes based on black, cyan, magenta, and yellow color image data input externally. The apparatus 100 corresponds to the sheet processing apparatus of the invention.

The image forming apparatus 100 includes an exposing unit 1, developing devices 2A to 2D, photoreceptor drums 3A to 3D, charging devices 4A to 4D, first transferring devices 5A to 5D, cleaning units 6A to 6D, an intermediate transferring belt 7, a second transferring device 8, a fusing unit 9, a sheet cassette 10, a manual feeding tray 11, and a sheet output tray 12.

The apparatus 100 performs an image forming process as described below. First, the charging devices 4A to 4D apply an electrostatic charge uniformly on respective circumferential surfaces of the drums 3A to 3D. Then, the exposing unit 1 irradiates the photoreceptor drums 3A to 3D with respective light beams that are modulated according to black, cyan, magenta, and yellow color image data. Thus, electrostatic latent images are formed on the respective circumferential surfaces of the drums 3A to 3D.

Next, the electrostatic latent images are developed into black, cyan, magenta, and yellow toner images, respectively, with the respective color toners stored in the developing devices 2A to 2D. The first transferring devices 5A to 5D serve to transfer the respective toner images as formed on the drums 3A to 3D to the intermediate transferring belt 7, so that the toner images are sequentially accumulated on the belt 7. Then, the accumulated toner images are transferred to a sheet by the second transferring device 8.

Inside the apparatus 100, a sheet transport path 17 is formed so as to lead from the sheet cassette 10 and the manual feeding tray 11, via a second transfer area 20 where the belt 7 faces the device 8 and through the fusing unit 9, to the sheet output tray 12. Along the path 17 provided are a pick-up roller 13, a sheet feeding unit 14, and a plurality of rollers including registration rollers 15 and sheet output rollers 16. The sheet output rollers 16 are rotatable in forward and backward directions. Also, a switchback transport path 18 is formed so as to lead from the rollers 16 to upstream of the registration rollers 15 in the path 17.

The second transferring device 8 transfers a toner image from the belt 7 to a sheet transported on the path 17 or 18. The fusing unit 9 has a heating roller 9A and a pressure roller 9B thereinside. Passing beyond the second transfer area 20, a sheet is transported through the heating roller 9A and the pressure roller 9B in order to be heated and pressed. Thus, a toner image on the sheet is fused and then fixed to the sheet.

Passing beyond the fusing unit 9, the sheet is output to the sheet output tray 12 by forward rotation of the sheet output rollers 16. In a double-sided image forming process, in contrast, the rollers 16 are rotated in the backward direction as soon as the rollers 16 hold a trailing end of a sheet with an image formed on a first side thereof. Thus, the sheet is guided into the switchback transport path 18 and transported to the second transfer area 20 with the first and second sides reversed. After an image is formed on the second side thereof, the sheet is output to the sheet output tray 12 by forward rotation of the rollers 16.

The sheet cassette 10 has a plurality of sheets of a size and a kind stored therein. The sheets to be stored in the sheet cassette 10 are ones that are frequently used in the apparatus 100, e.g., plain paper sheets of A4 size. The sheet cassette 10 is removably installed in the apparatus 100. When the sheet cassette 10 is to be replenished with sheets, the cassette 10 is pulled out of the apparatus 100.

The manual feeding tray 11 is used for feeding sheets that are different in size or kind from those stored in the sheet cassette 10. Accordingly, various sizes of sheets are to be placed on the manual feeding tray 11. The tray 11 is pivotably mounted at an end 11B thereof on a side wall 101 of the apparatus 100. More specifically, the tray 11 is pivotable between a closed position to cover a placement surface (upper surface) of a placement plate 11A of the tray 11 and an open position to expose the same. The placement surface is provided for sheets to be placed thereon. The end 11B is positioned adjacent to the sheet feeding unit 14. In other words, the placement surface is aligned approximately horizontally with the sheet feeding unit 14 and with the sheet transport path 17 when the tray 11 is in the open position.

Figure 2:
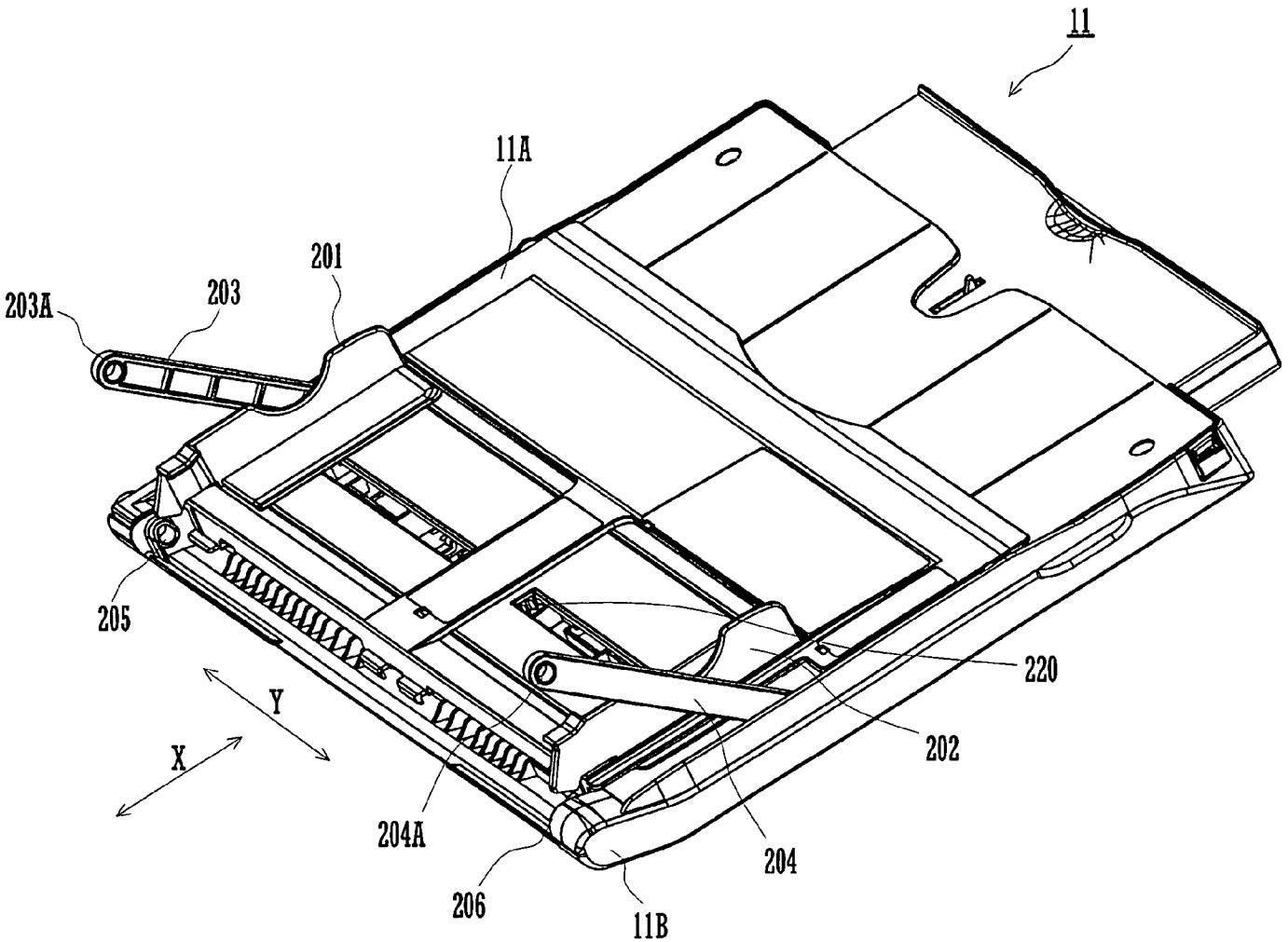
FIG. 2 is a perspective view of a manual feeding tray mounted on the image forming apparatus.

FIG. 2 is a perspective view of the tray 11.

Since the tray 11 is to be used for feeding various sizes of sheets, the tray 11 needs to be adapted so as to allow sheets to be placed in positions that are easily adjustable to the sizes. Thus, the tray 11 is provided with two guiding members 201 and 202. The guiding members 201 and 202 are slidable along an axis Y that is perpendicular to an axis X. Along the axis X, there are two opposite directions: a sheet feeding direction, and the first direction of the invention. The second direction of the invention is one of two opposite directions along the axis Y. In order to position a sheet along the axis Y, the guiding members 201 and 202 are to have contact with two respective sides, which are parallel to the axis X, of a sheet placed on the placement surface of the placement plate 11A. A transmitting mechanism to be described later allows the guiding members 201 and 202 to be slid in the respective opposite directions along the axis Y.

The tray 11 is pivotably mounted on the apparatus 100 through supports 205 and 206 that are provided in the end 11B. Connecting bars 203 and 204 are provided so as to project obliquely upward from both ends of the placement plate 11A along the axis Y. The bars 203 and 204 are pivotably attached at respective first ends 203A and 204 to the side wall 101. The first ends 203A and 204A are positioned above the supports 205 and 206, respectively. Also, the bars 203 and 204 are pivotably attached at respective second ends 203B and 204B to the respective guiding members 201 and 202 below the placement plate 11A.

Below the plate 11A disposed are two rack gears that are oriented parallel to the axis Y. The first rack gear is connected to the guiding member 201, and the second rack gear to the guiding member 202. Below the plate 11A, in addition, a pinion gear 220 is rotatably positioned centrally along the axis Y. The first and second rack gears are arranged opposite each other across the pinion gear 220 so as to mesh with the gear 220.

When the guiding member 201 is moved along the axis Y, the first rack gear is moved, thereby causing the pinion gear 220 to rotate. The first and second rack gears mesh with the pinion gear 220 in respective positions that are symmetric with respect to a central point of a teeth portion of the gear 220. Thus, movement of the first rack gear causes rotation of the pinion gear 220, thereby allowing movement of the second rack gear. The first and second rack gears, and therefore the guiding members 201 and 202, are moved equal distances in opposite directions. The first and second rack gears and the pinion gear 220 collectively correspond to the transmitting mechanism of the invention.

Between the guiding members 201 and 202, there is always a fixed middle point because the members 201 and 202 are moved equal distances in opposite directions along the axis Y. Accordingly, sheets are placed on the upper surface of the plate 11A, with a center location thereof fixed regardless of sizes.

Figure 3:
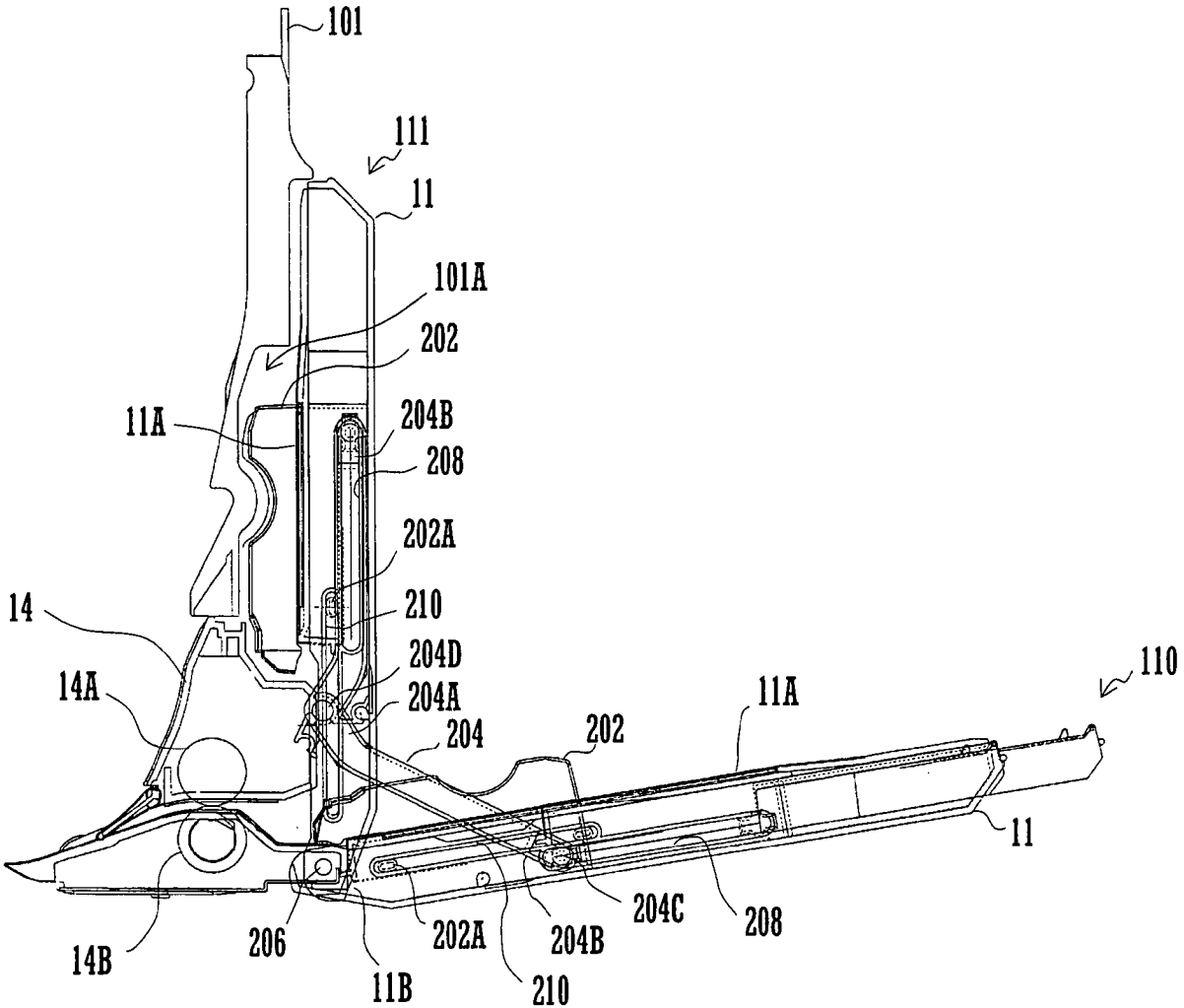
FIG. 3 is a cross-section of the tray, a side wall of the apparatus, and the proximity of the side wall, viewed from the front of the apparatus.

FIG. 3 is a cross-section of the tray 11, the side wall 101, and the proximity of the side wall 101, viewed from the front of the apparatus 100.

The tray 11 is adapted to be pivotable about the supports 205 and 206. More specifically, the tray 11 is adapted to be pivotable between an open position 110 and a closed position 111. On front side surfaces of the tray 11 provided are slits 208 and 210. On rear side surface of the tray 11 provided are slits 207 and 209 (not shown). All the slits 207 to 210 are oriented parallel to the sheet feeding direction, i.e., to the axis X.

The slits 207 and 208 are provided for guiding projections 203C and 204C therein, respectively. The projections 203C and 204C are formed in the respective second ends 203B and 204B of the connecting bars 203 and 204. The projection 203C and the bar 203 are not shown in the figure. The projections 203C and 204 are fitted into the slits 207 and 208, respectively, thereby being allowed to be guided in the respective lengthwise directions of the slits 207 and 208. The connecting bars 203 and 204 and the slits 207 and 208 collectively correspond to a moving member of the invention that is adapted to move the guiding members 201 (not shown in the figure) and 202.

The slits 209 and 210 are positioned nearer the apparatus 100 in relation to the slits 207 and 208, respectively. There are projections 201A (not shown in the figure) and 202A provided in respective side surfaces of the guiding members 201 and 202. The projections 201A and 202A are fitted into the slits 209 and 210, respectively. The slits 209 and 210 are provided for guiding therein the projections 201A and 202A, and thus the guiding members 201 and 202, respectively.

The projections 203C and 204C are fitted into holes (not shown) respectively provided in the side surfaces of the guiding members 201 and 202, as well as into the slits 207 and 208. Consequently, the connecting bars 203B and 204B are pivotably attached at the respective second ends 203B and 204B to the respective guiding members 201 and 202. Thus, as the projections 203C and 204C are respectively guided by the slits 207 and 208 and moved along the axis X, the guiding members 201 and 202 are also moved along the axis X. During the movement, the projections 201A and 202A are guided by the slits 209 and 210, respectively.

As the tray 11 is pivoted about the supports 205 and 206 from the open position 110 to the closed position 111, the connecting bars 203 and 204 are also pivoted counterclockwise in the figure about supports 203D and 204D, respectively. The connecting bars 203 and 204 are supported at the respective first ends 203A and 204A so as to be pivotable about the supports 203D and 204D. The supports 203D and 204D are positioned above the supports 205 and 206, respectively. More specifically, the bars 203 and 204 and the tray 11 have different pivot centers.

As the tray 11 is moved toward the closed position 111, the second ends 203B and 204B are moved away from the supports 205 and 206, respectively, along the respective lengthwise directions of the slits 207 and 208. It is because the projections 203C and 204C are fitted into the slits 207 and 208, respectively. Also, the guiding members 201 and 202 are moved away from the supports 205 and 206, respectively, along the respective lengthwise directions of the slits 207 and 208. It is because the projections 203C and 204C are fitted into the respective holes provided in the side surfaces of the guiding members 201 and 202. During the movement, the guiding members 201 and 202 are guided along the respective lengthwise directions of the slits 209 and 210 because the projections 201A and 202A are fitted into the slits 209 and 210, respectively.

Thus, the closing movement of the tray 11 involves the pivot movement of the connecting bars 203 and 204, thereby causing the guiding members 201 and 202 to be moved away from the supports 205 and 206, respectively. Accordingly, the guiding members 201 and 202 are prevented from having contact with components provided inside the apparatus 100, such as the sheet feeding unit 14, when the tray 11 is retracted in the sidewall 101.

Since the guiding members 201 and 202 project upward from the upper surface of the placement plate 11A, a concavity 101A is provided in the side wall 101. The members 201 and 202 are fitted into the concavity 101A when the tray 11 is in the closed position with the upper surface of the placement plate 11A adjacent to the side wall 101.

Inside the apparatus 100, on the other hand, components such as the sheet feeding unit 14 are located adjacent to the supports 205 and 206 for the purpose of smooth feeding of sheets placed on the placement plate 11A of the tray 11. Also, the guiding members 201 and 202 are positioned as adjacent to the apparatus 100 as possible when the tray 11 is in the open position, for the purpose of smooth feeding of the sheets into the apparatus 100.

Thus, when the tray 11 is moved to the closed position with the guiding members 201 and 202 positioned adjacent to the apparatus 100, the members 201 and 202 are brought into contact with the components such as the sheet feeding unit 14.

In the apparatus 100, thus, the guiding members 201 and 202 are adapted, when the tray 11 is moved to the closed position, to be moved away from the supports 205 and 206. The adaptation allows sheets to be smoothly fed when the tray 11 is in the open position and prevents the guiding members 201 and 202 from having contact with the components such as the sheet feeding unit 14 when the tray 11 is in the closed position.

Thus, the adaptation eliminates the need for such arrangement of the components as to prevent the guiding members 201 and 202 from having contact with the components when the tray 11 is in the closed position. Therefore, the apparatus 100 is prevented from having a complex internal structure.

Alternatively, a pivoting mechanism may be provided that is adapted, when the connecting bars 203 and 204 are pivoted, to fold respective projecting portions of the guiding members 201 and 202 parallel to the upper surface of the placement plate 11A, thereby preventing the guiding members 201 and 202 from having contact with the components of the apparatus 100 when the tray 11 is in the closed position. The pivoting mechanism includes female threaded portions, male screws, and a rotation transmitting member. The female threaded portions are provided in the second ends 203B and 204B, respectively. The screws are provided below the placement plate 11A in order to be fitted into the female threaded portions. The transmitting member transmits rotation of the screws to the guiding members 201 and 202.

Figure 4:
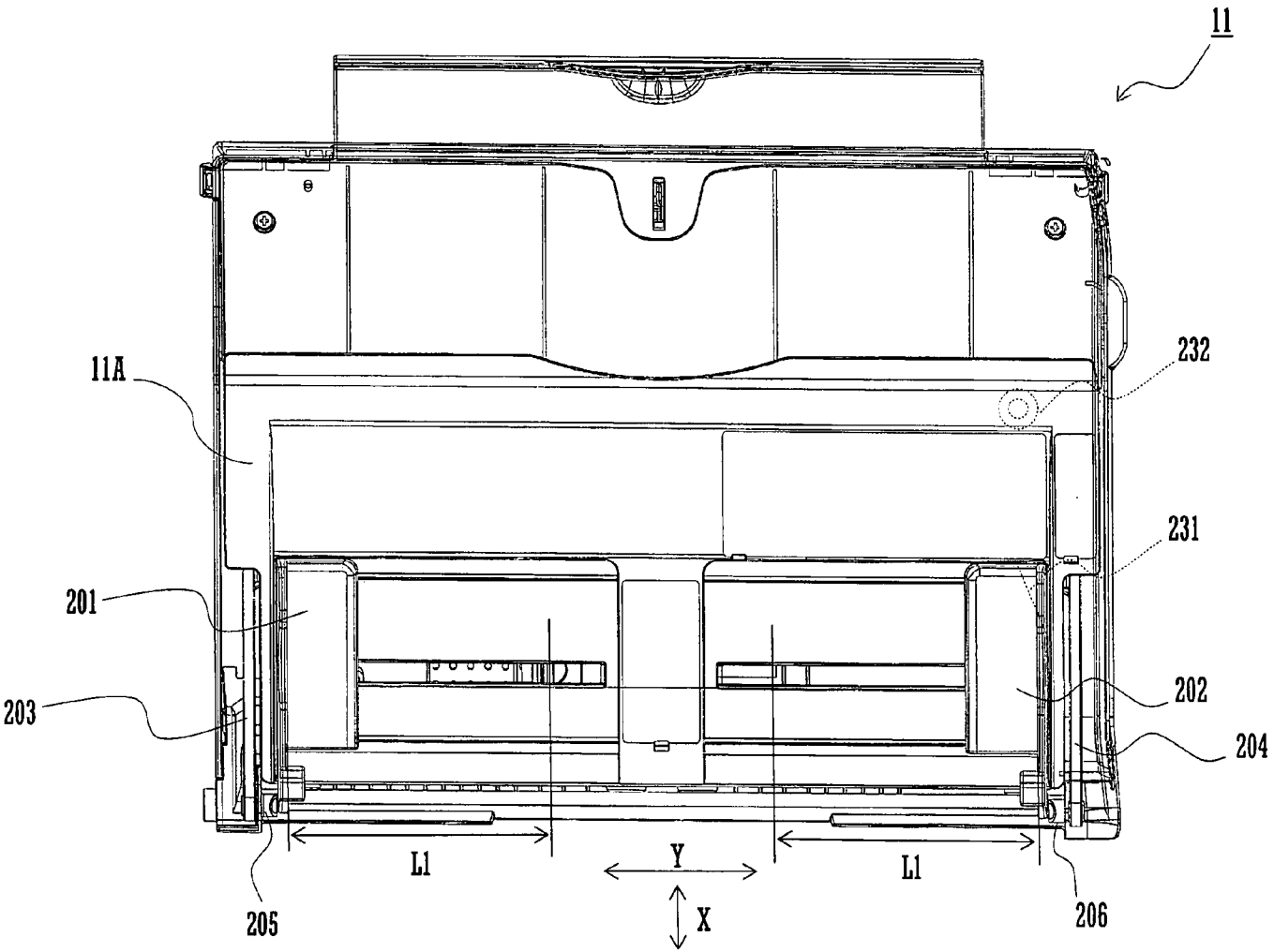
FIG. 4 is a plan view of the tray in an open position.
Figure 5:
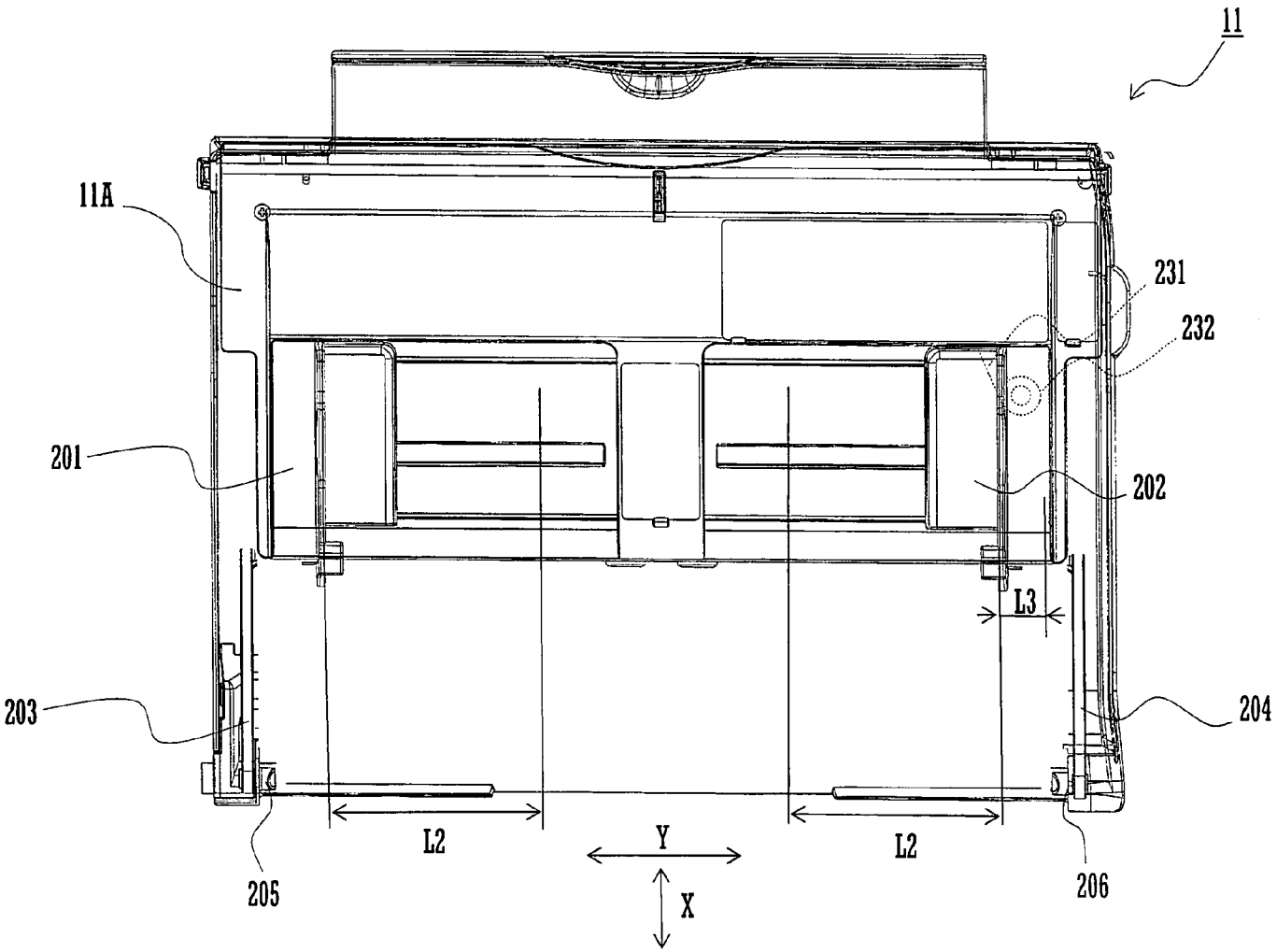
FIG. 5 is a plan view of the tray in a closed position.

FIG. 4 is a plan view of the tray 11 in the open position. FIG. 5 is a plan view of the tray 11 in the closed position. The guiding member 202 has a lower side surface with a slanted surface 231 formed therein. Below the placement plate 11A, there is a projection 232 provided so as to face the slanted surface 231 along the axis X.

As the tray 11 is pivoted from the open position as in FIG. 4 to the closed position as in FIG. 5, the guiding members 201 and 202 are moved away from the supports 205 and 206, thereby bringing the slanted surface 231 into contact with the projection 232. At the time, referring to FIG. 5, the guiding member 202 is moved a distance L3 toward the center of the tray 11. Force generated by the movement of the guiding member 202 is transmitted to the guiding member 201 through the transmitting mechanism, thereby causing the member 201 to be moved in a direction opposite to the direction in which the member 202 is moved. Thus, the guiding member 201 is also moved the distance L3 toward the center of the tray 11.

When the tray 11 is in the open position as in FIG. 4, each of the guiding members 201 and 202 is movable within a range of distance L1 along the axis Y. When the tray 11 is in the closed position as in FIG. 5, in contrast, each of the guiding members 201 and 202 is movable within a range of distance L2 along the axis Y.

Assume a situation in which the tray 11 is in the open position and each of the guiding members 201 and 202 is located outside the range of distance L2, i.e., in the range of distance L3. When the tray 11 is moved to the closed position in the situation, the guiding member 202 is moved along the axis X, thereby bringing the slanted surface 231 into contact with the projection 232. Each of the guiding members 201 and 202 is thus moved into the range of distance L2.

When the tray 11 is moved from the open position to the closed position with each of the guiding members 201 and 202 located within the range of distance L2, the guiding member 202 is moved along the axis X, but the slanted surface 231 is not brought into contact with the projection 232. Accordingly, the guiding members 201 and 202 are not moved along the axis Y.

In the apparatus 100, thus, the guiding members 201 and 202 are movable along the axis Y within a narrower range when the tray 11 is in the closed position than when the tray 11 is in the open position. The narrow movable range of the members 201 and 202 allows the concavity 11A to be narrow along the axis Y. This contributes to reduction of dead space inside the apparatus 100, and therefore to downsizing of the apparatus 100.

In the present embodiment, as described above, the slanted surface 231 is formed in the guiding member 202, and the projection 232 is provided below the placement plate 11A. In another embodiment, alternatively, a member with the slanted surface 231 may be provided below the placement plate 11A, and the projection 232 be provided in the guiding member 202.

The invention is applicable to a manual feeding tray for use in image forming apparatus or any apparatus that involves transport of sheets therein.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A manual sheet feeding mechanism adapted for use in a sheet processing apparatus, comprising:

a manual feeding tray adapted to be mounted on a side wall of the sheet processing apparatus so as to be pivotable about a first pivot axis between an open position and a closed position, the manual feeding tray having a placement surface for placing a sheet to be fed into the sheet processing apparatus;

a guiding member adapted to position a sheet placed on the placement surface by contact with both side ends of the sheet, the guiding member being provided so as to be movable on the placement surface; and a moving member adapted, when the manual feeding tray is pivoted toward the closed position, to move the guiding member on the placement surface, wherein the moving member is adapted, when the manual feeding tray is pivoted toward the closed position, to move the guiding member on the placement surface away from the first pivot axis along a first axis along which a sheet is fed.

2. The manual sheet feeding mechanism according to claim 1, wherein the moving member is further adapted, when the manual feeding tray is pivoted toward the closed position, to move the guiding member on the placement surface along a second axis perpendicular to the first axis.

3. The manual sheet feeding mechanism according to claim 2, wherein the moving member includes a connecting bar and a guiding slit, the connecting bar having a first end and a second end, the connecting bar being adapted to be attached at the first end to the sheet processing apparatus so as to be pivotable about a second pivot axis positioned above the first pivot axis, the connecting bar being also adapted to be pivotably attached at the second end to the guiding member, and the guiding slit being adapted to guide the second end along the first axis.

4. The manual sheet feeding mechanism according to claim 2, wherein the moving member is adapted, when the manual feeding tray is pivoted toward the closed position, to move the guiding member on the placement surface such that the guiding member has a narrower movable range than when the manual feeding tray is in the open position.

5. The manual sheet feeding mechanism according to claim 4, wherein the moving member includes a force translating member adapted, when the manual feeding tray is pivoted toward the closed position, to translate a force to move the guiding member along the first axis into a force to move the guiding member along the second axis.

6. The manual sheet feeding mechanism according to claim 5, wherein the force translating member is arranged adjacent to a side end of the manual feeding tray and is adapted, when the manual feeding tray is pivoted toward the closed position with the guiding member positioned in a predetermined area that extends in the second direction and is adjacent to the side end, to translate the force to move the guiding member along the first axis into the force to move the guiding member along the second axis.

7. The manual sheet feeding mechanism according to claim 6, wherein the guiding member includes:

a first guiding portion;

a second guiding portion; and a transmitting mechanism, the first and second guiding portions being arranged to have contact with the respective side ends of the sheet, and the transmitting mechanism being adapted to translate a first force to move the first guiding portion in a direction along the second axis into a second force to move the second guiding portion in an opposite direction along the second axis, wherein the force translating member includes a slanted surface formed in the first guiding portion and a projection provided below the placement surface so as to face the slanted surface, and wherein the moving member is adapted, when the manual feeding tray is pivoted toward the closed position with the first guiding portion positioned in the predetermined area, to move the first guiding portion on the placement surface away from the first pivot axis along the first axis, whereby moving the first guiding portion along the second axis by contact of the slanted surface with the projection.

8. The manual sheet feeding mechanism according to claim 6, wherein the guiding member includes:

a first guiding portion;

a second guiding portion; and a transmitting mechanism, the first and second guiding portions being adapted to have contact with the respective side ends of the sheet, and the transmitting mechanism being adapted to translate a first force to move the first guiding portion in a direction along the second axis into a second force to move the second guiding portion in an opposite direction along the second axis, wherein the force translating member includes a projection formed in the first guiding portion and a member provided below the placement surface, the member having a slanted surface formed so as to face the projection, and wherein the moving member is adapted, when the manual feeding tray is pivoted toward the closed position with the first guiding portion positioned in the predetermined area, to move the first guiding portion on the placement surface away from the first pivot axis along the first axis, whereby moving the first guiding portion along the second axis by contact of the projection with the slanted surface.

* * * * *